US010886683B2

(12) United States Patent
Onuma

(10) Patent No.: US 10,886,683 B2
(45) Date of Patent: Jan. 5, 2021

(54) METHOD FOR MANUFACTURING TERMINAL-EQUIPPED ELECTRIC WIRE

(71) Applicant: Yazaki Corporation, Tokyo (JP)

(72) Inventor: Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 294 days.

(21) Appl. No.: 16/016,538

(22) Filed: Jun. 22, 2018

(65) Prior Publication Data

US 2018/0375275 A1 Dec. 27, 2018

(30) Foreign Application Priority Data

Jun. 26, 2017 (JP) ..... 2017-124576

(51) Int. Cl.
*H01R 43/00* (2006.01)
*H01R 4/18* (2006.01)
(Continued)

(52) U.S. Cl.
CPC ..... *H01R 43/005* (2013.01); *H01R 4/185* (2013.01); *B05D 1/02* (2013.01); *B05D 3/067* (2013.01);
(Continued)

(58) Field of Classification Search
CPC ..... B05D 1/02; B05D 3/067; H01R 4/185; H01R 4/70; H01R 43/005; H01R 43/048
See application file for complete search history.

(56) References Cited

U.S. PATENT DOCUMENTS 8,641,461 B2 * 2/2014 Mitose ..... H01R 4/185 439/587
8,974,258 B2 * 3/2015 Mitose ..... H01R 4/184 439/877
(Continued)

FOREIGN PATENT DOCUMENTS

JP 2006-286385 A * 10/2006
JP 2007-052999 A * 3/2007
(Continued)

OTHER PUBLICATIONS

Japanese Office Action for the related Japanese Patent Application No. 2017-124576 dated Apr. 16, 2019.

*Primary Examiner* — Carl J Arbes
(74) *Attorney, Agent, or Firm* — Kenealy Vaidya LLP

(57) ABSTRACT

A method for manufacturing a terminal-equipped electric wire includes a coating forming process for forming, on a terminal-equipped electric wire having a terminal including a core wire crimping part that holds a core wire of an electric wire and a covering crimping part crimped to a covering of the electric wire, a coating of an ultraviolet-curing resin that integrally covers the core wire and the terminal, and an irradiating process for irradiating the coating with ultraviolet rays. At the coating forming process, while a discharge port that intermittently ejects droplets of the ultraviolet-curing resin and the terminal-equipped electric wire are moved relative to each other, the coating is formed from the ultraviolet-curing resin ejected from the discharge port. A direction of the relative movement of the discharge port and the terminal-equipped electric wire at the coating forming process includes directions orthogonal to an ejection direction of the droplets.

11 Claims, 9 Drawing Sheets

(51) Int. Cl.

| | |
|---|---|
| *H01R 43/048* | (2006.01) |
| *B05D 1/02* | (2006.01) |
| *B05D 3/06* | (2006.01) |
| *H01R 4/70* | (2006.01) |

(52) U.S. Cl.
CPC ..... *B05D 2202/00* (2013.01); *H01R 4/70* (2013.01); *H01R 43/048* (2013.01)

(56) References Cited

U.S. PATENT DOCUMENTS

| | | | | |
|---|---|---|---|---|
| 10,290,396 | B2 * | 5/2019 | Ito | H01B 7/282 |
| 2013/0012077 | A1 | 1/2013 | Sato et al. | |

FOREIGN PATENT DOCUMENTS

| | | | | |
|---|---|---|---|---|
| JP | 2010-108828 | A | | 5/2010 |
| JP | 2011-216253 | A | | 10/2011 |
| JP | 5606267 | B | * | 1/2012 |
| JP | 2014-117075 | A | * | 6/2014 |
| JP | 2015-153715 | A | | 8/2015 |
| JP | 2015-153717 | A | | 8/2015 |
| JP | 2016-219233 | A | | 12/2016 |
| JP | 2016-225171 | A | | 12/2016 |
| JP | 2017-4878 | A | | 1/2017 |

* cited by examiner

METHOD FOR MANUFACTURING TERMINAL-EQUIPPED ELECTRIC WIRE

CROSS-REFERENCE TO RELATED APPLICATION(S)

The present application claims priority to and incorporates by reference the entire contents of Japanese Patent Application No. 2017-124576 filed in Japan on Jun. 26, 2017.

BACKGROUND OF THE INVENTION

1. Field of the Invention

The present invention relates to a method for manufacturing a terminal-equipped electric wire.

2. Description of the Related Art

There have conventionally been corrosion preventive techniques for terminal-equipped electric wires. Japanese Patent Application Laid-open No. 2016-225171 discloses a technique of a method for manufacturing a terminal-equipped electric wire including a sealing process for applying a sealing resin in a first viscosity state so as to cover a core wire exposed part of a covered electric wire to seal the core wire exposed part, a core wire heating process for heating the core wire exposed part to change the sealing resin therearound to a second viscosity state, which is lower in viscosity than the first viscosity state, to cause the sealing agent to penetrate between a terminal and a core wire and the space between element wires of the core wire, and to fill gaps between them, and a curing process for curing the sealing resin as a whole.

Japanese Patent Application Laid-open No. 2017-4878 discloses a technique of a covering apparatus that covers a connecting part between a conductor part and a conductor connecting part of a terminal-equipped electric wire including an electric wire and a terminal metal fitting having the conductor connecting part connected to the conductor part of the electric wire and a box-shaped terminal connecting part to be connected to a mating terminal with a covering material. The covering apparatus of Japanese Patent Application Laid-open No. 2017-4878 has a holding means for holding the terminal-equipped electric wire. The holding means has a terminal masking part that includes a housing part housing the terminal connecting part to cover the terminal connecting part.

Japanese Patent Application Laid-open No. 2016-219233 discloses a technique of an apparatus for supporting an electric wire-equipped terminal used when a sealant is supplied from a nozzle to an electric wire-terminal connecting part. The apparatus for supporting an electric wire-equipped terminal of Japanese Patent Application Laid-open No. 2016-219233 includes a terminal simple holding part that detachably holds an electric contact of a terminal fitting and an electric wire simple holding part that detachably holds a resin covering of the electric wire when the electric wire is bent to cause the electric wire to produce a reaction force to return to its original state.

It is desirable that man-hours required for corrosion preventive treatment be reduced to improve the productivity of terminal-equipped electric wires. If the time required for resin coating formation can be reduced, for example, the productivity of terminal-equipped electric wires can be improved.

SUMMARY OF THE INVENTION

An object of the present invention is to provide a method for manufacturing a terminal-equipped electric wire with improved productivity.

In order to solve the above mentioned problem and achieve the object, a method for manufacturing a terminal-equipped electric wire according to one aspect of the present invention includes forming, on a terminal-equipped electric wire having a terminal including a core wire crimping part that holds a core wire of an electric wire between tips of a pair of conductor crimping pieces connected to a bottom wall and the bottom wall and a covering crimping part crimped to a covering of the electric wire, a coating of an ultraviolet-curing resin that integrally covers the core wire and the terminal; and irradiating the coating with ultraviolet rays, wherein at the forming, while a discharge port that intermittently ejects droplets of the ultraviolet-curing resin and the terminal-equipped electric wire are moved relative to each other, the coating is formed from the ultraviolet-curing resin ejected from the discharge port, and a direction of the relative movement of the discharge port and the terminal-equipped electric wire at the forming is a direction orthogonal to an ejection direction of the droplets.

According to another aspect of the present invention, in the method for manufacturing the terminal-equipped electric wire, it is preferable that the direction of the relative movement of the discharge port and the terminal-equipped electric wire at the forming includes two directions orthogonal to the ejection direction of the droplets, and the two directions are a width direction of the terminal and a direction orthogonal to the width direction.

According to still another aspect of the present invention, in the method for manufacturing the terminal-equipped electric wire, it is preferable that in the pair of conductor crimping pieces, curved parts between respective basal end parts connected to the bottom wall and respective tips holding the core wire are in contact with each other, and at the forming, the ultraviolet-curing resin fills a groove defined by the curved parts being in contact with each other.

According to still another aspect of the present invention, in the method for manufacturing the terminal-equipped electric wire, it is preferable that at the forming, the ultraviolet-curing resin fills the groove such that the ultraviolet-curing resin piles up to a position higher than tops of the curved parts.

According to still another aspect of the present invention, in the method for manufacturing the terminal-equipped electric wire, it is preferable that an amount of the droplets ejected at a time is an amount that causes a spread of the droplets when adhering to the core wire crimping part to be smaller than a width of the core wire crimping part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a method for manufacturing a terminal-equipped electric wire according to an embodiment of the present invention in detail with reference to the accompanying drawings. This embodiment does not limit this invention. Components of the embodiment described below include those that can be easily thought of by those skilled in the art and those that are substantially the same.

EMBODIMENT

Figure 1:
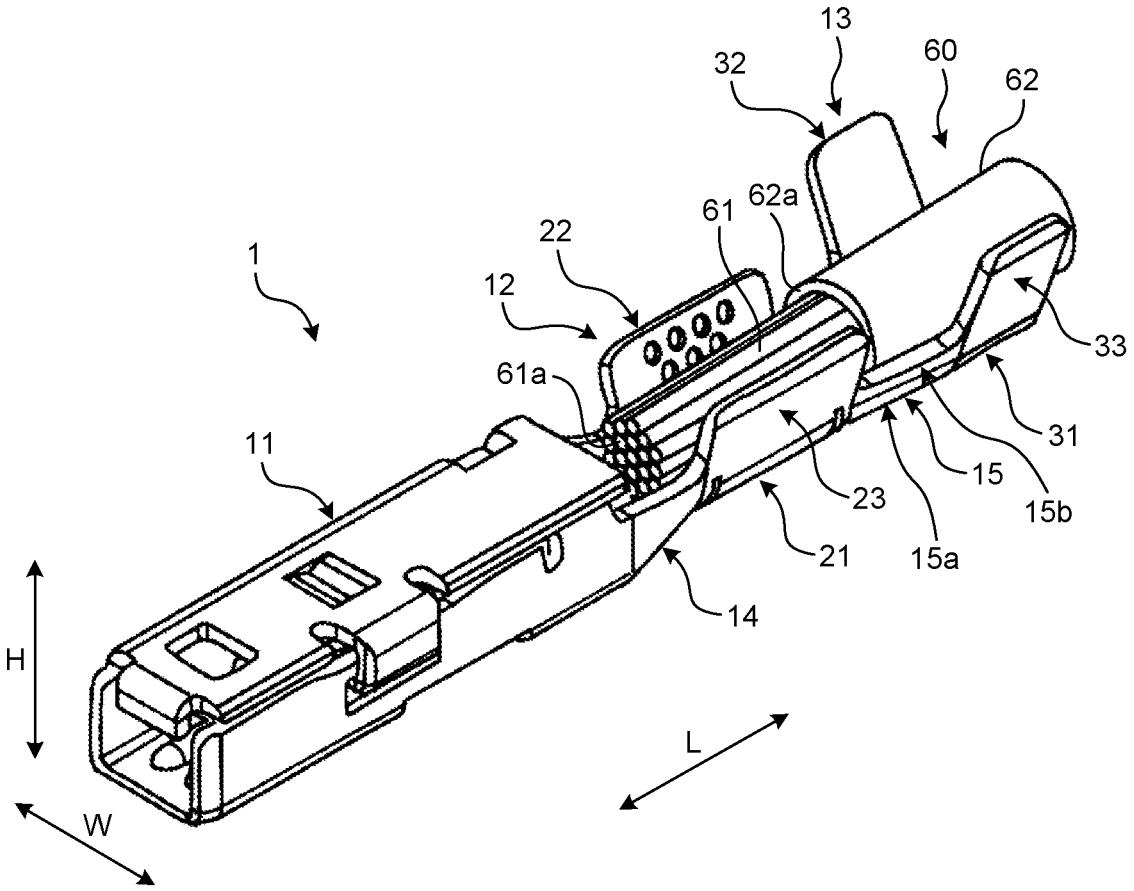
FIG. 1 is a perspective view of a crimp terminal and an electric wire according to an embodiment.
Figure 2:
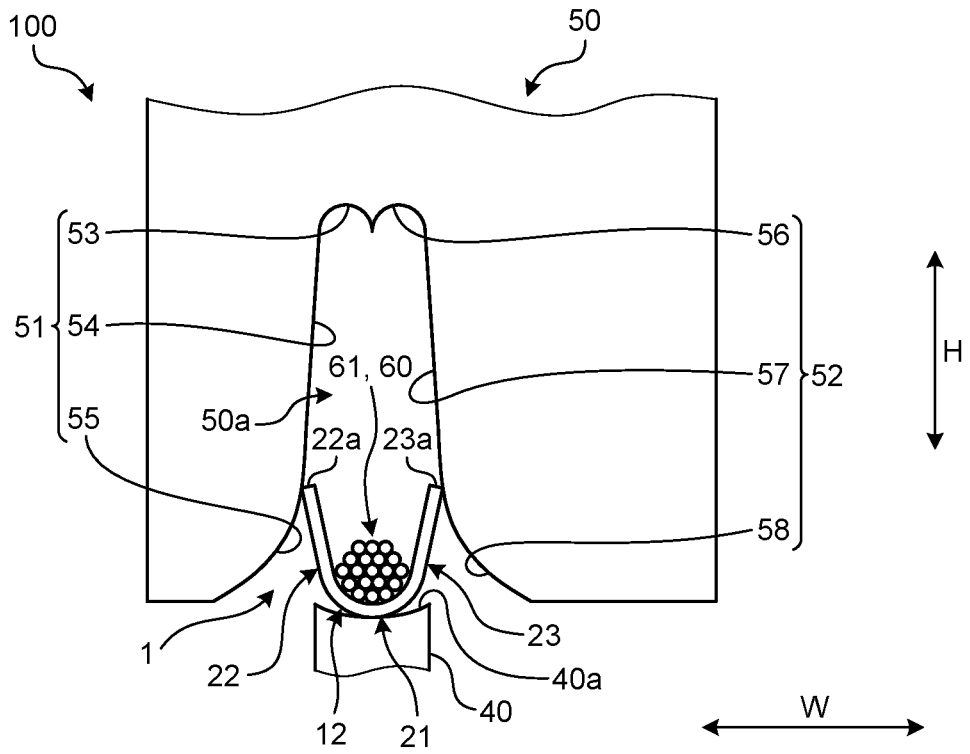
FIG. 2 is an elevational view for explaining the crimping of the crimp terminal by a die for terminal crimping according to the embodiment.
Figure 3:
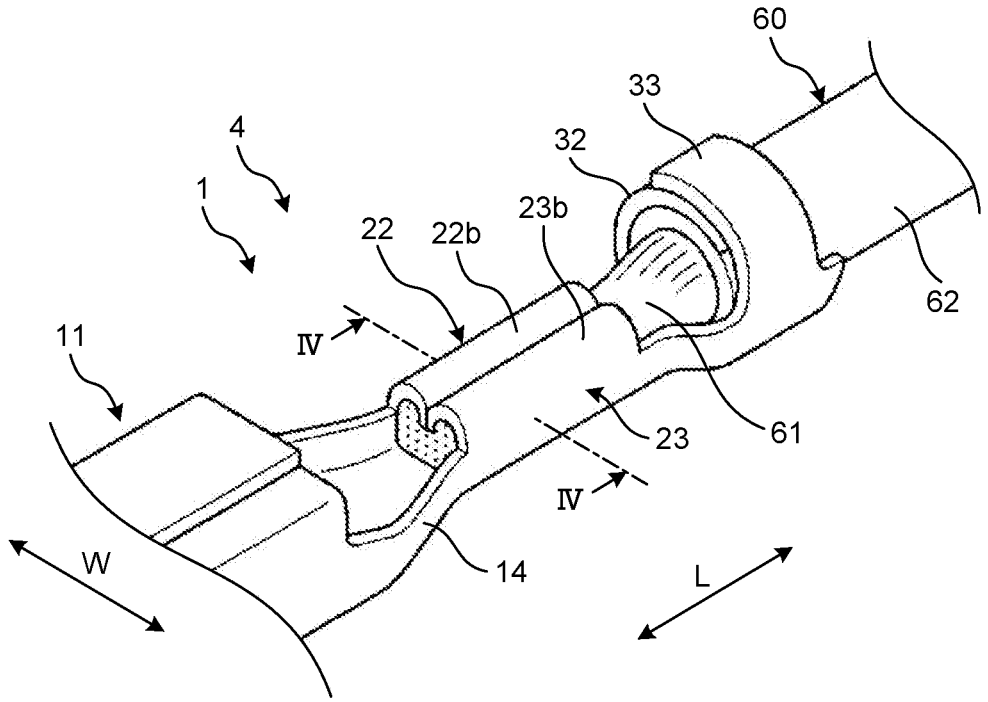
FIG. 3 is a perspective view of a terminal-equipped electric wire before coating formation according to the embodiment.
Figure 4:
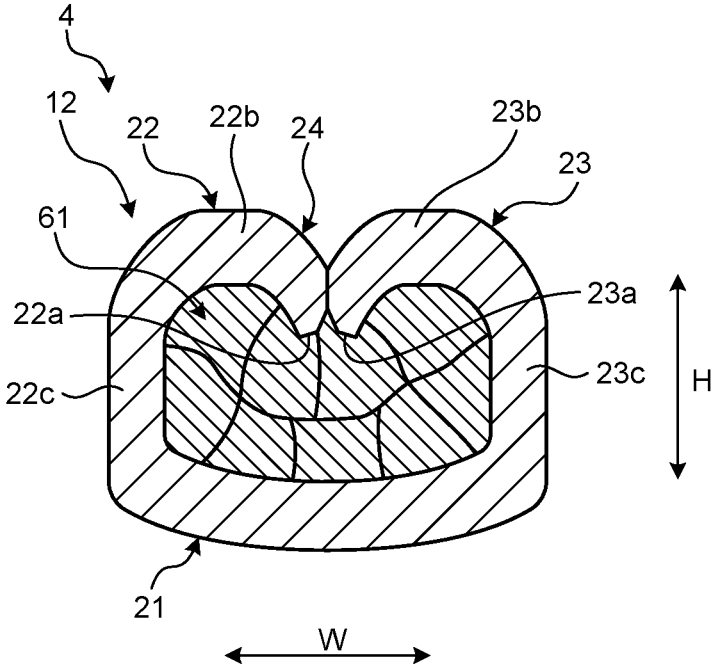
FIG. 4 is a sectional view of the terminal-equipped electric wire before coating formation according to the embodiment.
Figure 5:
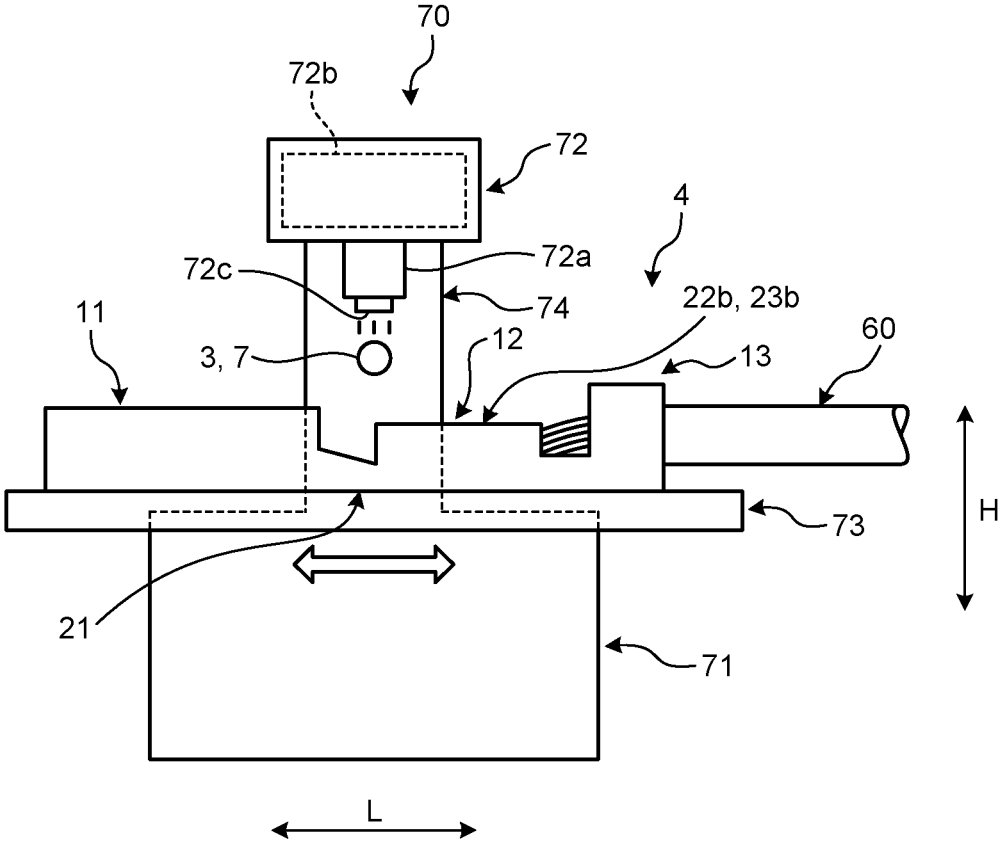
FIG. 5 is a diagram of an ejecting apparatus according to the embodiment.
Figure 6:
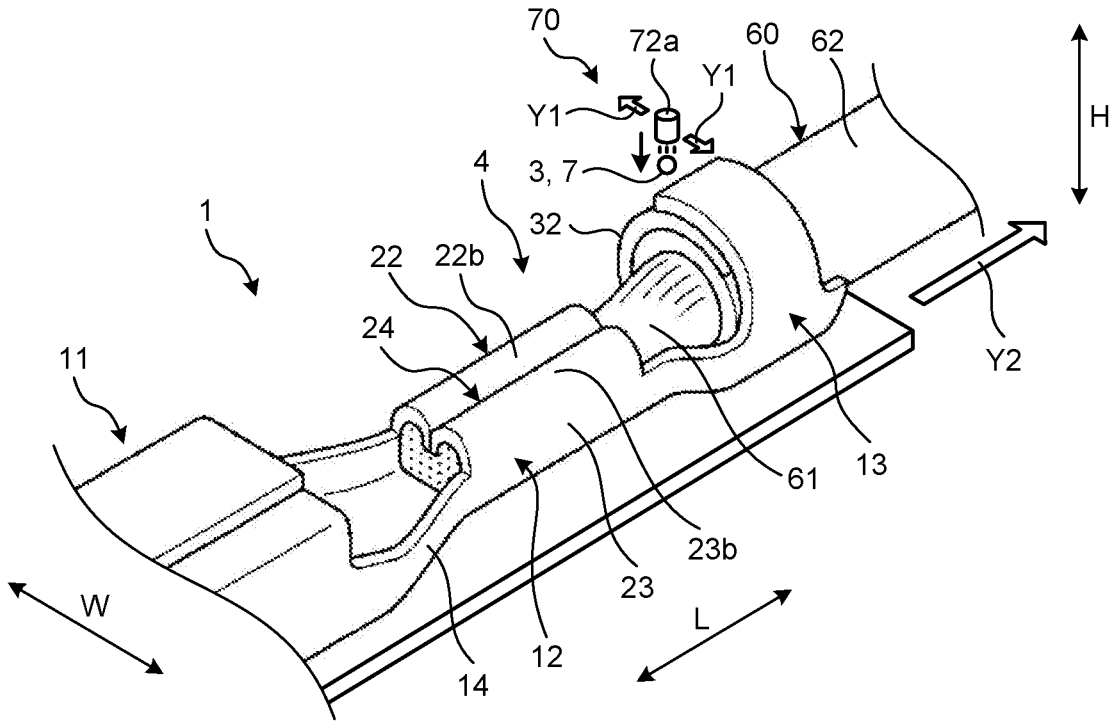
FIG. 6 is a perspective view of a coating forming process of the embodiment.
Figure 7:
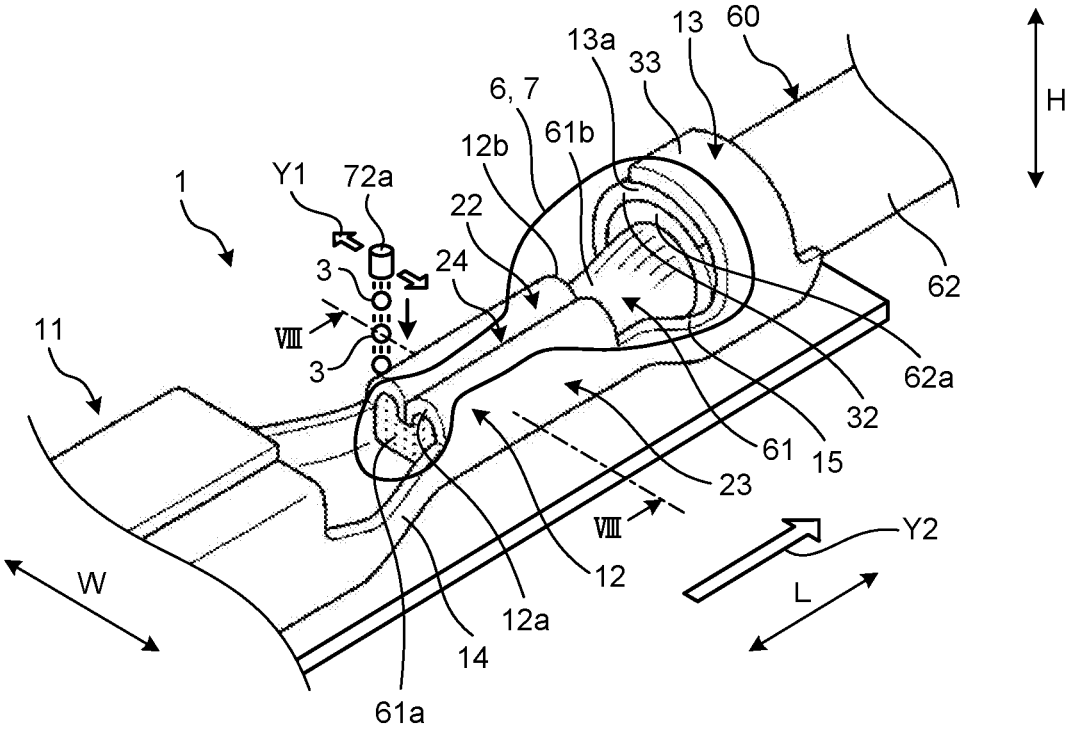
FIG. 7 is a perspective view for explaining a coating of the embodiment.
Figure 8:
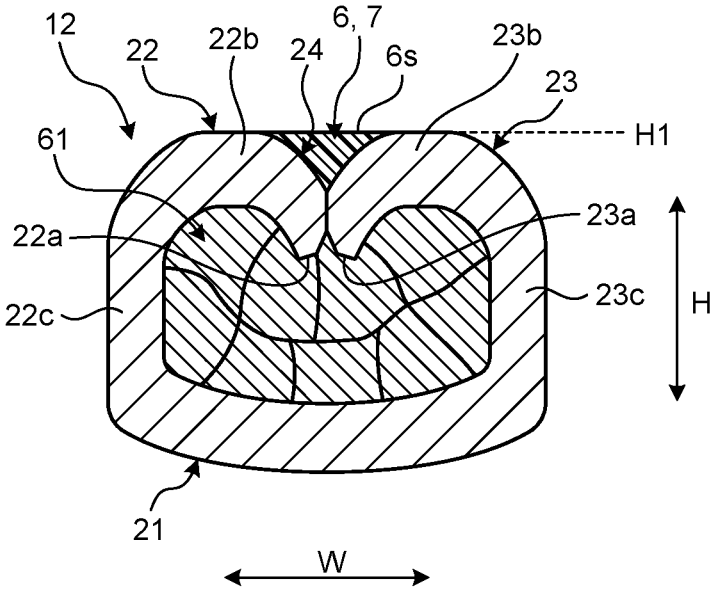
FIG. 8 is a sectional view for explaining the coating of the embodiment.
Figure 9:
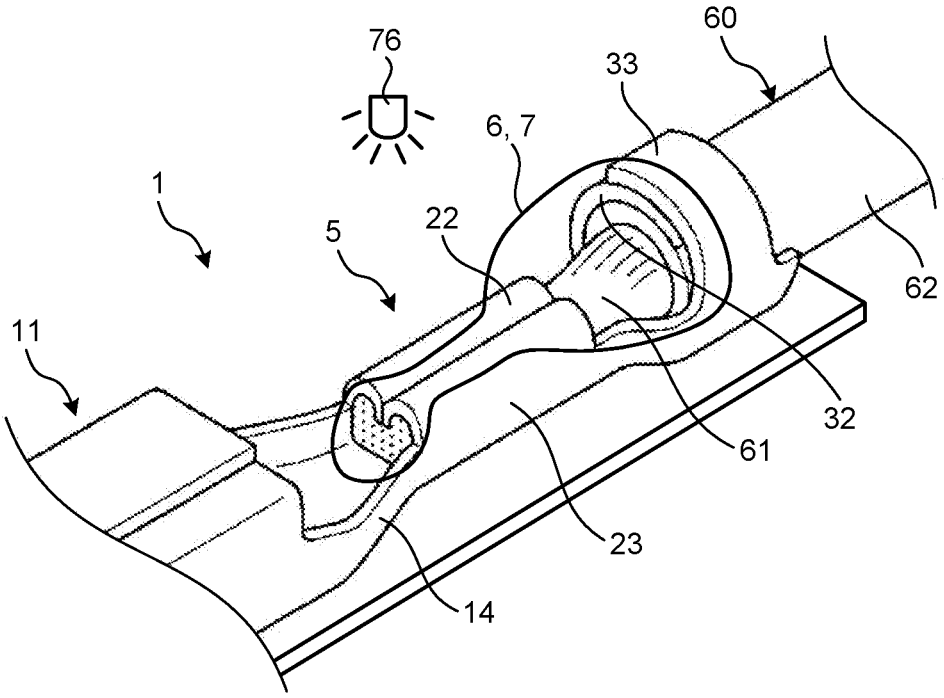
FIG. 9 is a perspective view of an irradiating process of the embodiment.
Figure 10:
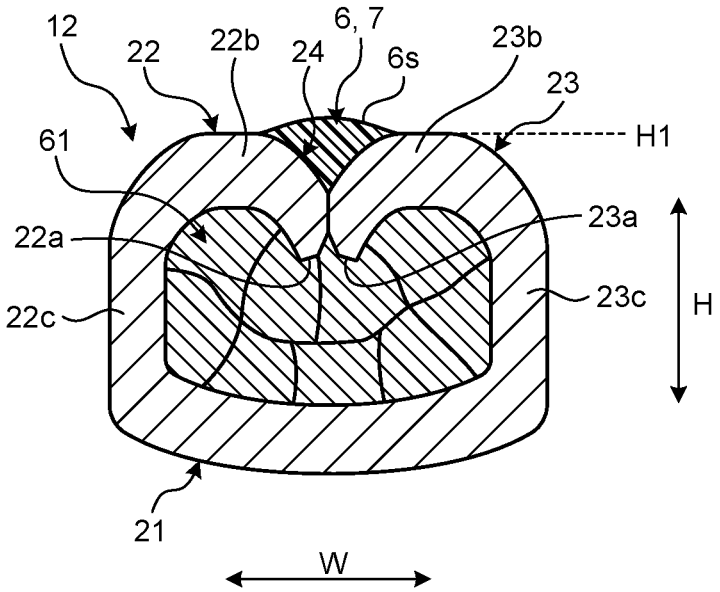
FIG. 10 is another sectional view for explaining the coating of the embodiment.
Figure 11:
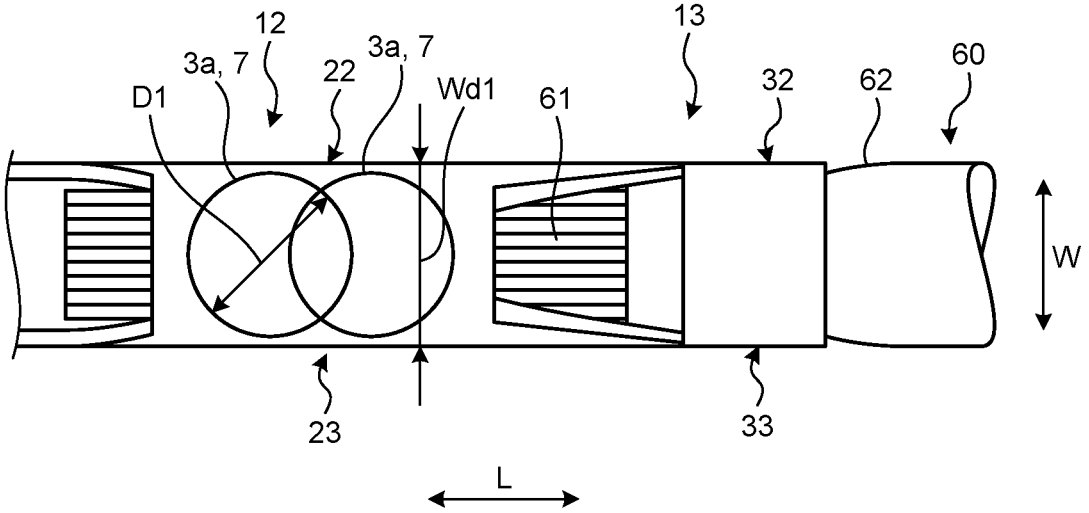
FIG. 11 is a plan view of a spread of droplets of the embodiment.
Figure 12:
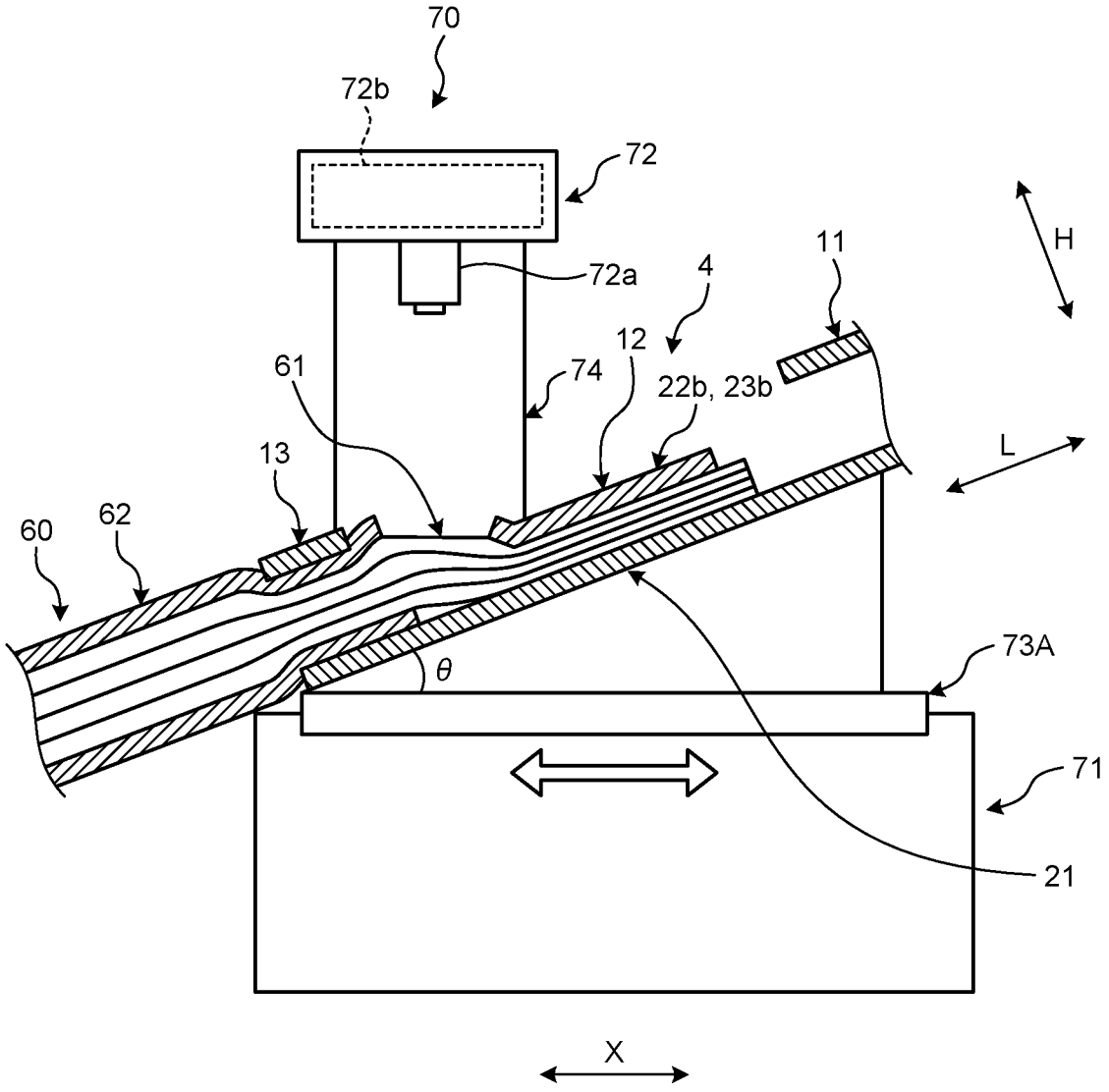
FIG. 12 is a diagram of another mode of the ejecting apparatus according to the embodiment.
Figure 13:
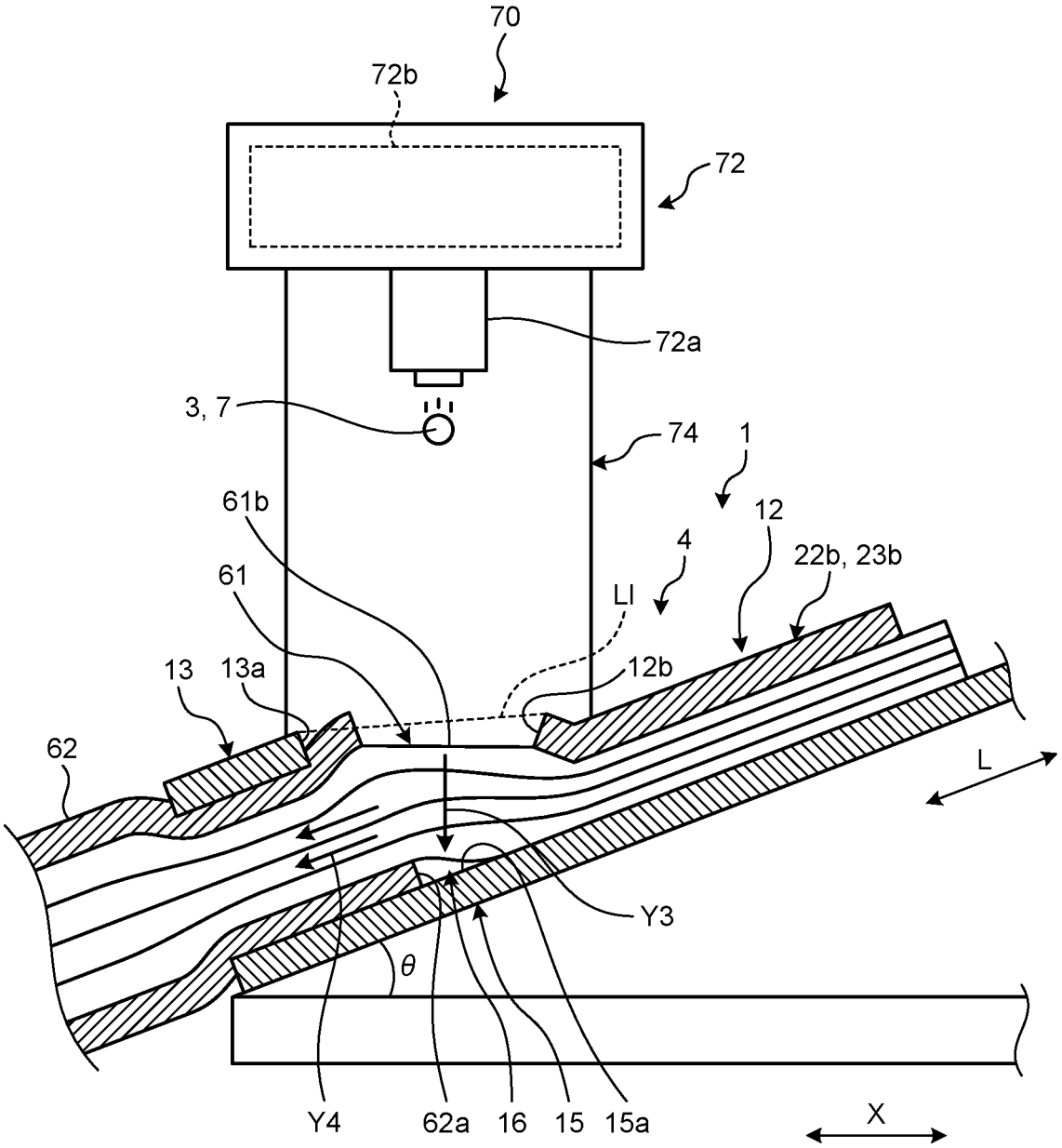
FIG. 13 is a sectional view of the terminal-equipped electric wire before coating formation according to the embodiment.
Figure 14:
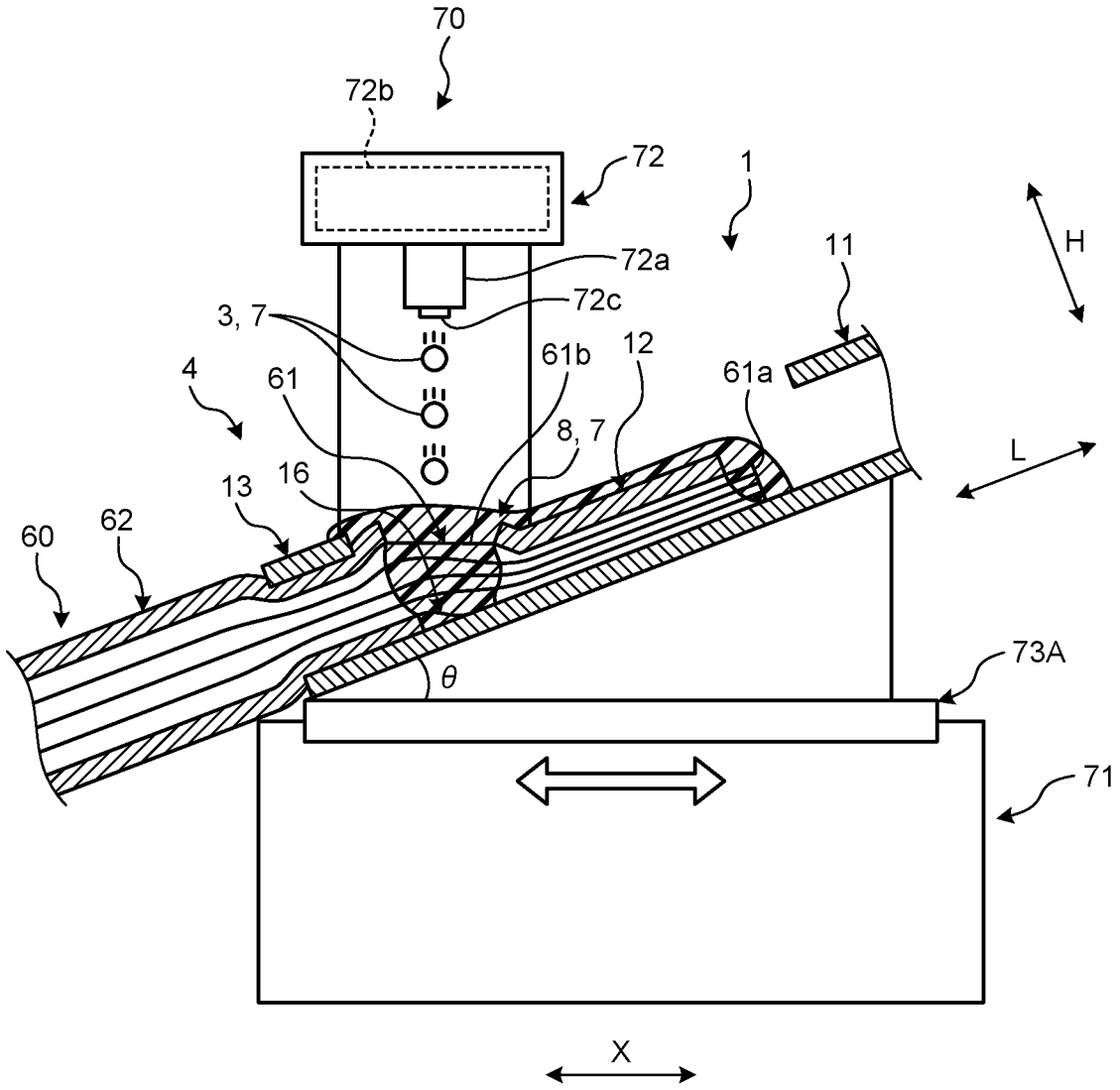
FIG. 14 is a sectional view for explaining a coating of the embodiment.

The following describes the embodiment with reference to FIG. 1 to FIG. 14. The present embodiment relates to a method for manufacturing a terminal-equipped electric wire. FIG. 1 is a perspective view of a crimp terminal and an electric wire according to the embodiment, FIG. 2 is an elevational view for explaining the crimping of the crimp terminal by a die for terminal crimping according to the embodiment, FIG. 3 is a perspective view of a terminal-equipped electric wire before coating formation according to the embodiment, FIG. 4 is a sectional view of the terminal-equipped electric wire before coating formation according to the embodiment, FIG. 5 is a diagram of an ejecting apparatus according to the embodiment, FIG. 6 is a perspective view of a coating forming process of the embodiment, FIG. 7 is a perspective view for explaining a coating of the embodiment, FIG. 8 is a sectional view for explaining the coating of the embodiment, FIG. 9 is a perspective view of an irradiating process of the embodiment, FIG. 10 is another sectional view for explaining the coating of the embodiment, FIG. 11 is a plan view of a spread of droplets of the embodiment, FIG. 12 is a diagram of another mode of the ejecting apparatus according to the embodiment, FIG. 13 is a sectional view of the terminal-equipped electric wire before coating formation according to the embodiment, and FIG. 14 is a sectional view for explaining a coating of the embodiment. FIG. 4 is a IV-IV sectional view of FIG. 3.

As illustrated in FIG. 1, this crimp terminal 1 according to the present embodiment has a terminal connecting part 11, a core wire crimping part 12, and a covering crimping part 13. The terminal connecting part 11, the core wire crimping part 12, and the covering crimping part 13 are arranged in a longitudinal direction of the crimp terminal 1 in this order. The crimp terminal 1 is formed from a conductive metallic plate (a copper plate or a copper alloy plate, for example) as a base material. The crimp terminal 1 is formed in a certain shape by punching, bending, and the like of the base material. The surface of the crimp terminal 1 may be plated with tin (Sn) or the like.

In the present specification, in the description of the crimp terminal 1, a connection direction with a mating terminal, that is, an insertion direction with the mating terminal is referred to as a first direction L. The first direction L is the longitudinal direction of the crimp terminal 1. A width direction of the crimp terminal 1 is referred to as a second direction W. The second direction W is orthogonal to the first direction L. In the crimp terminal 1, a direction orthogonal to both the first direction L and the second direction W is referred to as a third direction H. The third direction H is a compression direction by a crimper 50 when the crimp terminal 1 is crimped. The third direction H is a height direction of the crimp terminal 1.

The terminal connecting part 11 is a part electrically connected with the mating terminal. The shape of the terminal connecting part 11 of the present embodiment is a quadrangular tubular shape. The core wire crimping part 12 is a part to be crimped to a core wire 61 of an electric wire 60. The electric wire 60 has the core wire 61 and a covering 62. The material of the core wire 61 is copper or aluminum, for example. In the electric wire 60 to be crimped by the crimp terminal 1, the covering 62 at an end is removed to expose the core wire 61 by a certain length. The core wire 61 of the present embodiment is an aggregate of a plurality of element wires. However, the core wire 61 may be a single wire such as a coaxial cable. The crimp terminal 1 is crimped to the end of the electric wire 60 to be electrically connected to the exposed core wire 61.

The shape of the core wire crimping part 12 before being crimped to the core wire 61 is a U shape as illustrated in FIG. 1. The core wire crimping part 12 has a bottom 21, a first barrel piece 22, and a second barrel piece 23. The bottom 21 is a bottom wall of the core wire crimping part 12 and is supported by an anvil 40 described below. The first barrel piece 22 and the second barrel piece 23 are a pair of conductor crimping pieces to be crimped to the core wire 61. The first barrel piece 22 is a side wall protruding from one end of the bottom 21 in a width direction. The second barrel piece 23 is a side wall protruding from the other end of the bottom 21 in width direction. The first barrel piece 22 and the second barrel piece 23 extend in a direction crossing the width direction of the bottom 21. The first barrel piece 22 and the second barrel piece 23 are opposite to each other in the second direction W. As illustrated in FIG. 1 and FIG. 2, the spacing between the first barrel piece 22 and the second barrel piece 23 increases from the bottom 21 toward their tips.

As illustrated in FIG. 1, the covering crimping part 13 has a bottom 31, a third barrel piece 32, and a fourth barrel piece 33. The shape of the covering crimping part 13 before being crimped to the covering 62 is a U shape as illustrated in FIG. 1. The bottom 31 is a bottom wall of the covering crimping part 13. The third barrel piece 32 is a side wall protruding from one end of the bottom 31 in the width direction. The fourth barrel piece 33 is a side wall protruding from the other end of the bottom 31 in the width direction. The third barrel piece 32 and the fourth barrel piece 33 are opposite to each other in the second direction W. The spacing between the third barrel piece 32 and the fourth barrel piece 33 increases from the bottom 31 toward their tips. The covering crimping part 13 is crimped to the covering 62 by the anvil 40 and the crimper 50.

The terminal connecting part 11 and the core wire crimping part 12 are connected to each other via an intermediate part 14. The height of the intermediate part 14 is lower than any of the height of the terminal connecting part 11 and the height of the core wire crimping part 12. The core wire crimping part 12 and the covering crimping part 13 are connected to each other via an intermediate part 15. The intermediate part 15 has a bottom 15*a* and side walls 15*b*. The bottom 15*a* connects the bottom 21 of the core wire crimping part 12 and the bottom 31 of the covering crimping part 13 to each other. Each of the side walls 15*b* extends from each side of the bottom 15*a*. One of the side walls 15*b* connects the first barrel piece 22 and the third barrel piece 32 to each other. The other of the side walls 15*b* connects the second barrel piece 23 and the fourth barrel piece 33 to each other. The height of the side walls 15*b* is lower than any of the heights of the barrel pieces 22 and 23 of the core wire crimping part 12 and the heights of the barrel pieces 32 and 33 of the covering crimping part 13.

As illustrated in FIG. 1, the electric wire 60 is placed on the crimp terminal 1 such that the axial direction of the electric wire 60 coincides with the longitudinal direction of the crimp terminal 1. Placed on the crimp terminal 1, a front end 61*a* of the core wire 61 is directed toward the terminal connecting part 11. The core wire 61 exposed out of the covering 62 is placed on the core wire crimping part 12. In this process, the front end 61*a* of the core wire 61 may protrude from the core wire crimping part 12 toward the terminal connecting part 11. The covering 62 of the electric wire 60 is placed on the covering crimping part 13. In other words, the electric wire 60 is placed such that a front end 62*a* of the covering 62 is positioned between the core wire crimping part 12 and the covering crimping part 13.

The core wire crimping part 12 and the covering crimping part 13 are crimped to the electric wire 60 by the anvil 40 and the crimper 50 illustrated in FIG. 2. The anvil 40 and the crimper 50 are components of a terminal crimping apparatus 100. The anvil 40 is a support side die supporting the core wire crimping part 12 and the covering crimping part 13 from below. A support face 40*a* of the anvil 40 supports an outer face of the bottom 21 of the core wire crimping part 12. Consequently, with the core wire crimping part 12 supported by the anvil 40, the first barrel piece 22 and the second barrel piece 23 have an attitude extending from the bottom 21 obliquely upward. The anvil 40 similarly supports the covering crimping part 13 from below.

The crimper 50 is a die for terminal crimping that holds the crimp terminal 1 and the electric wire 60 between the crimper 50 and the anvil 40 to crimp the crimp terminal 1 to the electric wire 60. The crimper 50 holds the core wire crimping part 12 and the core wire 61 between the crimper 50 and the anvil 40 to crimp the core wire crimping part 12 to the core wire 61. The crimper 50 holds the covering crimping part 13 and the covering 62 between the crimper 50 and the anvil 40 to crimp the covering crimping part 13 to the covering 62. As illustrated in FIG. 2, the crimper 50 is arranged above the anvil 40. The crimper 50 relatively moves in the third direction H relative to the anvil 40. The terminal crimping apparatus 100 has a drive unit that moves the crimper 50 upward and downward in the third direction H.

As illustrated in FIG. 2, the crimper 50 has a recessed crimping part 50*a*. The crimping part 50*a* is a groove-shaped recess provided on a lower face of the crimper 50. The crimper 50 of the present embodiment crimps the core wire crimping part 12 to the core wire 61 based on what is called the B-type crimping method (refer to FIG. 4). As illustrated in FIG. 2, the crimping part 50*a* has a first wall face 51 and a second wall face 52. The first wall face 51 and the second wall face 52 are opposite to each other in the second direction W.

The first wall face 51 and the second wall face 52 have curved surface parts 53 and 56, respectively, intermediate parts 54 and 57, respectively, and bases 55 and 58, respectively. The first wall face 51 and the second wall face 52 are formed symmetrically relative to the second direction W, for example. The curved surface parts 53 and 56 are positioned on the most inner parts of the first wall face 51 and the second wall face 52, respectively. The curved surface parts 53 and 56 are opposite faces opposite to the anvil 40 in the third direction H. The intermediate parts 54 and 57 connect the curved surface parts 53 and 56, respectively, and the bases 55 and 58, respectively to each other. The sectional shape of the intermediate parts 54 and 57 is linear or substantially linear, for example. The intermediate parts 54 and 57 are inclined so as to be directed toward respective ends of the crimper 50 in the second direction W from the curved surface parts 53 and 56, respectively, toward the bases 55 and 58, respectively.

The bases 55 and 58 are positioned on the side of the first wall face 51 and the second wall face 52, respectively, nearest the entrance. The bases 55 and 58 are curved so as to be directed toward the respective ends of the crimper 50 in the second direction W from the intermediate parts 54 and 57, respectively, toward the entrance of the crimping part 50*a*.

Method for Manufacturing Terminal-Equipped Electric Wire

The following describes the method for manufacturing a terminal-equipped electric wire according to the present embodiment. The method for manufacturing a terminal-equipped electric wire includes a crimping process, a coating forming process, and an irradiating process. The crimping process is a process for crimping the crimp terminal 1 to the electric wire 60. The coating forming process is a process for forming a coating 6 of an ultraviolet-curing resin 7 that integrally covers the core wire 61 and the core wire crimping part 12. The irradiating process is a process for irradiating the coating 6 with ultraviolet rays.

Crimping Process

The crimping process is performed by the terminal crimping apparatus 100. The terminal crimping apparatus 100 lowers the crimper 50 toward the anvil 40 with the crimp terminal 1 and the electric wire 60 supported by the anvil 40. As illustrated in FIG. 2, the core wire 61 is placed in an internal space surrounded by the bottom 21, the first barrel piece 22, and the second barrel piece 23 and is placed on an inner face of the bottom 21, for example. When the crimper 50 lowers toward the anvil 40, the first barrel piece 22 comes into contact with the first wall face 51, whereas the second barrel piece 23 comes into contact with the second wall face 52 as illustrated in FIG. 2.

The curved surface part 53 of the first wall face 51 bends the first barrel piece 22 toward the second barrel piece 23 to curve the first barrel piece 22. More specifically, the first wall face 51 curves the first barrel piece 22 in a substantially J shape such that a tip 22*a* of the first barrel piece 22 is opposite to the core wire 61 in the third direction H. The curved surface part 56 of the second wall face 52 bends the second barrel piece 23 toward the first barrel piece 22 to curve the second barrel piece 23. More specifically, the second wall face 52 curves the second barrel piece 23 in a substantially J shape such that a tip 23*a* of the second barrel piece 23 is opposite to the core wire 61 in the third direction H.

The first wall face 51 and the second wall face 52 press the first barrel piece 22 toward the second barrel piece 23 and press the second barrel piece 23 toward the first barrel piece 22. Consequently, as illustrated in FIG. 3 and FIG. 4, the core wire crimping part 12 is crimped to the core wire 61 such that its sectional shape is formed in a substantially B shape. As illustrated in FIG. 4, in the core wire crimping part 12 after being crimped, curved parts 22*b* and 23*b* are formed in the first barrel piece 22 and the second barrel piece 23, respectively. The shape of the curved parts 22*b* and 23*b* is a curved shape protruding toward a side opposite to the bottom 21.

The curved part 22*b* of the first barrel piece 22 is bent such that the tip 22*a* is positioned nearer to the second barrel piece 23 than a basal end 22*c*. The curved part 23*b* of the second barrel piece 23 is bent such that the tip 23*a* is positioned nearer to the first barrel piece 22 than a basal end 23*c*. The respective tips 22*a* and 23*a* of the barrel pieces 22 and 23 hold the core wire 61 of the electric wire 60 between the tips 22*a* and 23*a* and the bottom 21. The barrel pieces 22 and 23 wrap the core wire 61 by the curved parts 22*b* and 23*b*, the basal ends 22*c* and 23*c*, and the bottom 21 to be crimped to the core wire 61.

The curved part 22*b* of the first barrel piece 22 and the curved part 23*b* of the second barrel piece 23 are in contact with each other. More specifically, respective parts of the curved parts 22*b* and 23*b* on the tip side are in contact with each other in the second direction W. The curved parts 22*b* and 23*b* being in contact with each other form a groove 24. The groove 24 is a groove-shaped part defined by respective wall faces of the curved parts 22*b* and 23*b* and extends in the first direction L. The width of the groove 24 in the second direction W decreases toward the bottom 21.

As illustrated in FIG. 3, for example, the covering crimping part 13 is crimped to the covering 62 in a mutually overlapping manner. The third barrel piece 32 is wound around an outer circumferential face of the covering 62, whereas the fourth barrel piece 33 is wound around the outside of the third barrel piece 32, for example. However, the crimped state of the covering crimping part 13 is not limited to this example; the third barrel piece 32 and the fourth barrel piece 33 may be wound around different positions of the covering 62 in the first direction L, for example.

In the present embodiment, the coating 6 of the ultraviolet-curing resin 7 is formed on the crimp terminal 1 and the electric wire 60 after being crimped. Given this situation, a terminal-equipped electric wire before the coating 6 is formed is referred to as a "terminal-equipped electric wire 4 before coating formation," whereas a final terminal-equipped electric wire after the coating 6 is formed is referred to simply as a "terminal-equipped electric wire 5."

Coating Forming Process

The coating forming process is performed by an ejecting apparatus 70 illustrated in FIG. 5, for example. The ejecting apparatus 70 is an apparatus that intermittently ejects droplets 3 of the ultraviolet-curing resin 7. The ultraviolet-curing resin 7 is a urethane acrylate-based resin, for example. As illustrated in FIG. 5, the ejecting apparatus 70 has a main body 71, an ejecting part 72, and a holding part 73. The main body 71 is a main body of the ejecting apparatus 70 and is fixed to a mount such as a workbench. The ejecting part 72 is supported by the main body 71 via an arm 74. The ejecting part 72 has a nozzle 72*a* and an ejecting mechanism 72*b*. The nozzle 72*a* is a cylindrical hollow member. A discharge port 72*c* at the tip of the nozzle 72*a* is directed toward the holding part 73.

The ejecting mechanism 72*b* is a mechanism that intermittently ejects the droplets 3 of the ultraviolet-curing resin 7 from the nozzle 72*a*. The ejecting mechanism 72*b* intermittently pressure-feeds a constant amount of the resin to the nozzle 72*a* by the reciprocation of a piston or the like. Examples of means for imparting an energizing force to the piston include a spring and a piezoelectric element. The resin fed to the nozzle 72*a* flies out of the tip of the nozzle 72*a*. The resin that has flown out of the nozzle 72*a* flies in the form of the droplets 3 toward the holding part 73. The droplets 3 are given acceleration by the ejecting mechanism 72*b*. Consequently, the droplets 3 travel along a trajectory on an extension of the nozzle 72*a*.

The holding part 73 holds the terminal-equipped electric wire 4 before coating formation. The holding part 73 holds the terminal-equipped electric wire 4 before coating formation at a position opposite to the nozzle 72*a*. The terminal-equipped electric wire 4 before coating formation is held with the bottom 21 directed downward and the curved parts 22*b* and 23*b* directed upward. In other words, the terminal-equipped electric wire 4 before coating formation is held by the holding part 73 in an attitude in which the third direction H coincides with the vertical direction. The terminal-equipped electric wire 4 before coating formation is held by the holding part 73 such that the axial direction of the crimp terminal 1 is the horizontal direction. In other words, the terminal-equipped electric wire 4 before coating formation is held such that the first direction L is horizontal.

The holding part 73 can relatively move in the first direction L relative to the main body 71 of the ejecting apparatus 70. The ejecting apparatus 70 has a drive mechanism that relatively moves the holding part 73 in the first direction L relative to the main body 71. The drive mechanism is a mechanism including a motor, for example. The holding part 73 moves in the first direction L, whereby the relative position of the terminal-equipped electric wire 4 before coating formation relative to the nozzle 72*a* changes. The movable range of the holding part 73 is set so as to enable the droplets 3 to adhere to a range from the front end of the core wire 61 to the covering crimping part 13. In other words, the holding part 73 can move the terminal-equipped electric wire 4 before coating formation in the first direction L from a position at which the front end of the core wire 61 is opposite to the nozzle 72*a* to a position at which the covering crimping part 13 is opposite to the nozzle 72*a*.

The ejecting mechanism 72*b* has a mechanism that moves the nozzle 72*a* in the second direction W. The second direction W is a direction orthogonal to the drawing in FIG. 5. In other words, the ejecting apparatus 70 can change the relative position of the terminal-equipped electric wire 4 before coating formation and the nozzle 72*a* in the first direction L and the second direction W. The movable range of the nozzle 72*a* corresponds to the width of the core wire crimping part 12. The nozzle 72*a* can move from a position opposite to one end of the core wire crimping part 12 in the second direction W to a position opposite to the other end thereof in the second direction W. In the ejecting apparatus 70 of the present embodiment, the relative position of the nozzle 72*a* relative to the holding part 73 is fixed in the third direction H. In other words, the nozzle 72*a* does not relatively move in the third direction H relative to the holding part 73.

FIG. 6 illustrates the terminal-equipped electric wire 4 before coating formation positioned at a position at which the nozzle 72*a* and the covering crimping part 13 are opposite to each other. The ejecting apparatus 70 of the present embodiment applies the ultraviolet-curing resin 7 from the covering crimping part 13 toward the terminal connecting part 11. The ejecting apparatus 70 ejects the droplets 3 at regular time intervals from the nozzle 72*a*. The ejected droplets 3 travel in the air in the third direction H to adhere to the terminal-equipped electric wire 4 before coating formation. The ejecting apparatus 70 reciprocates the nozzle 72*a* in the second direction W as indicated by the arrow Y1 while intermittently ejecting the droplets 3.

The ejecting apparatus 70 moves the holding part 73 in the first direction L as indicated by the arrow Y2. The movement direction of the holding part 73 is a direction directed from the core wire crimping part 12 toward the covering crimping part 13. The ejecting apparatus 70 ejects the droplets 3 successively at certain intervals while relatively moving the terminal-equipped electric wire 4 before coating formation and the nozzle 72*a* as described above to form the coating 6 (FIG. 7) that integrally covers the core wire 61 and the core wire crimping part 12. The coating 6 of the present embodiment covers the exposed part of the core wire 61 to isolate the exposed part of the core wire 61 from the external space. In the terminal-equipped electric wire 4 before coating formation of the present embodiment, the exposed part of the core wire 61 includes the front end 61*a* and an intermediate exposed part 61*b* of the core wire 61.

The front end 61*a* is a part exposed from the core wire crimping part 12 toward the terminal connecting part 11 in the terminal-equipped electric wire 4 before coating formation. The intermediate exposed part 61*b* is a part exposed between the core wire crimping part 12 and the covering crimping part 13 in the terminal-equipped electric wire 4 before coating formation. The coating 6 of the present embodiment integrally covers the front end 61*a*, the core wire crimping part 12, the intermediate exposed part 61*b*, the intermediate part 15, the covering crimping part 13, and the covering 62.

More specifically, the coating 6 integrally covers the front end 61*a* of the core wire 61 and a front end 12*a* of the core wire crimping part 12. The coating 6 isolates the front end 61*a* from the external space to hinder water and the like from entering the front end 61*a* from the terminal connecting part 11. The coating 6 may entirely cover the front end 12*a* of the core wire crimping part 12. In the crimp terminal 1 formed from the base material plated with tin or the like, copper may be exposed at a place cut by press working or the like such as the front end 12*a*. When copper is exposed at the front end 12*a*, the front end 12*a* is entirely covered, whereby corrosion of the core wire 61 is not likely to occur.

The coating 6 covers the groove 24 of the core wire crimping part 12. As illustrated in FIG. 8, the coating 6 of the ultraviolet-curing resin 7 fills the groove 24. The coating 6 is formed such that the position of a surface 6*s* of the coating 6 in the third direction H is a position equal to a top position H1 of the curved parts 22*b* and 23*b*, for example. The coating 6 formed in the groove 24 hinders water and the like from entering the core wire 61 via the groove 24. In addition, the coating 6 formed in the groove 24 hinders water or the like from accumulating in the groove 24. Water and the like is not likely to accumulate in the groove 24, so that the degradation of the plating of the core wire crimping part 12 can be suppressed.

The coating 6 formed on the core wire crimping part 12 is preferably formed in the range of the groove 24 in the second direction W. The coating 6 may be formed in the range from the top of the curved part 22*b* to the top of the curved part 23*b*, for example. The formation range of the coating 6 is made not to expand to the outside of the range of the groove 24, so that the ultraviolet-curing resin 7 will not be likely to adhere to side faces of the core wire crimping part 12. Consequently, variations in crimp wide are not likely to occur.

As illustrated in FIG. 7, the coating 6 integrally covers a rear end 12*b* of the core wire crimping part 12, the intermediate part 15, a front end 13*a* of the covering crimping part 13, the front end 62*a* of the covering 62, and the intermediate exposed part 61*b*. The coating 6 isolates the intermediate exposed part 61*b* from the external space to hinder water and the like from entering the intermediate exposed part 61*b*. The coating 6 may be formed so as not to cover an outer circumferential face of the covering crimping part 13. The coating 6 may be formed so as to cover the front end 13*a* of the covering crimping part 13 and not to cover the outer circumferential face of the covering crimping part 13, for example. The coating 6 is not formed on the outer circumferential face of the covering crimping part 13, so that variations in the height dimension and the width dimension of the covering crimping part 13 will not be likely to occur.

As described above, the coating 6 isolates the core wire 61 from the external space to hinder water from entering between the core wire 61 and the crimp terminal 1. Consequently, the coating 6 can suppress the occurrence of corrosion in the terminal-equipped electric wire. When the material of the core wire 61 is aluminum, whereas the material of the crimp terminal 1 is copper, for example, when water enters between the two, the core wire 61 corrodes (galvanically corrodes) owing to a difference in ionization tendency. The coating 6 hinders the entry of water, thereby suppressing the occurrence of corrosion.

Irradiating Process

The irradiating process is a process for irradiating the coating 6 with ultraviolet rays. The irradiating process is performed after the completion of the coating forming process or in parallel with the coating forming process. The irradiating process may be performed by a dedicated irradiating apparatus or be performed by the ejecting apparatus 70. At the irradiating process, as illustrated in FIG. 9, an ultraviolet irradiating apparatus 76 irradiates the coating 6 with ultraviolet rays. The coating 6 is irradiated with the ultraviolet rays to be cured. When the coating 6 is cured at the irradiating process, the manufacture of the terminal-equipped electric wire 5 is completed.

In the method for manufacturing a terminal-equipped electric wire of the present embodiment, the droplets 3 intermittently ejected form the coating 6. The ejecting part 72 can cause the droplets 3 to adhere to target places with high precision. Examples of a method of coating formation to be compared include a method of application that discharges paste-like resin from a nozzle continuously without a break while moving the nozzle. In this method of application, the followability of the resin to the movement of the nozzle is not high. Consequently, the movement speed of the nozzle is limited, which makes improvement in productivity difficult. The followability of the resin is low, and deviation between the position of the nozzle and a position at which the discharged resin actually adheres to an electric wire and the like occurs. In the method to be compared, it is difficult to control an application position and an application range, unevenness in application occurs, and there is a possibility that high corrosion prevention reliability may not be achieved.

In contrast, in the method for manufacturing a terminal-equipped electric wire according to the present embodiment, the ejecting part 72 that intermittently ejects the droplets 3 forms the coating 6. In this method, deviation between the ejection position of the nozzle 72*a* and a position to which the ejected droplets 3 adhere is not likely to occur. In other words, the droplets 3 can be made to hit target places with high precision. The ejecting apparatus 70 of the present embodiment is not likely to be subject to the constraint of followability as in the method to be compared. Consequently, the ejecting apparatus 70 can increase the movement speed of the nozzle 72*a* and the movement speed of the holding part 73 to improve productivity.

In addition, the ejecting apparatus 70 of the present embodiment can easily adjust the thickness of the coating 6. The thickness of the coating 6 is adjusted by the relative movement speed of the nozzle 72*a* and the terminal-equipped electric wire 4 before coating formation, for example. By lowering the relative speed, or stopping the relative movement, the thickness of the coating 6 can be increased. In contrast, by increasing the relative speed, the thickness of the coating 6 can be reduced.

In addition, the ejecting apparatus 70 of the present embodiment forms the coating 6 without performing relative movement in the third direction H. In the method to be compared, to achieve a desired application amount (application thickness), the nozzle is required to be moved upward and downward. The nozzle is required to be moved in the third direction H in accordance with the height of a target part for application such as the core wire crimping part 12 and the core wire 61, for example.

In contrast, the ejecting apparatus 70 of the present embodiment forms the coating 6 without moving the nozzle 72*a* in the third direction H. Regardless of the height of a target part for forming the coating 6 (hereinafter, referred to simply as the "target part"), the ejecting apparatus 70 can cause the droplets 3 in any amount to adhere to the target part. Consequently, in the method for manufacturing a terminal-equipped electric wire of the present embodiment, the movement of the nozzle 72*a* in the third direction H is absent, and thus a processing time at the coating forming process is reduced. In addition, the ejecting apparatus 70 of the present embodiment can eliminate resin dripping during application to reduce material loss.

As illustrated in FIG. 10, the ejecting apparatus 70 may pile up the surface 6*s* of the coating 6 above the top position H1. The coating 6 illustrated in FIG. 10 fills the groove 24 so as to pile up to a position higher than the top position H1 of the curved parts 22*b* and 23*b*. Such a structure hinders water and oil from entering the groove 24. Consequently, the terminal-equipped electric wire 5 can be protected from galvanic corrosion more surely.

In the present embodiment, the amount of the droplets 3 ejected at a time is set as follows, for example. FIG. 11 illustrates droplets 3*a* that have hit the core wire crimping part 12 and have adhered thereto. A diameter D1 of the adhering droplets 3*a* corresponds to a spread of the droplets 3 at the time of adhering to the core wire crimping part 12. The diameter D1 of the droplets 3*a* is smaller than a width (crimp wide) Wd1 of the core wire crimping part 12. Consequently, the ultraviolet-curing resin 7 is not likely to adhere to the side faces of the core wire crimping part 12. Thus, the ejecting apparatus 70 of the present embodiment can reduce variations in the width Wd1 caused by the adherence of the ultraviolet-curing resin 7 to the side faces.

FIG. 12 illustrates another mode of the ejecting apparatus 70 according to the present embodiment. In the ejecting apparatus 70 illustrated in FIG. 12, a holding part 73A holds the terminal-equipped electric wire 4 before coating formation at an inclined attitude. A movement direction X of the holding part 73A is a direction orthogonal to the axial direction of the nozzle 72*a*, that is, a direction orthogonal to an ejection direction in which the droplets 3 are ejected. The movement direction X is a horizontal direction, for example. The holding part 73A holds the terminal-equipped electric wire 4 before coating formation at the inclined attitude such that the first direction L is inclined relative to the movement direction X. FIG. 12 to FIG. 14 illustrate sectional views of the terminal-equipped electric wire 4 before coating formation. The sectional views are along a central axial line of the electric wire 60 and are orthogonal to the second direction W. An angle of inclination θ of the first direction L relative to the movement direction X is an angle as described below, for example.

FIG. 13 illustrates a principal part of FIG. 12 in an enlarged manner. The angle of inclination θ of the present embodiment is set such that an imaginary line LI is made parallel to the movement direction X. The imaginary line LI is a line connecting an upper end of the rear end 12*b* of the core wire crimping part 12 and an upper end of the front end 13*a* of the covering crimping part 13. In other words, the angle of inclination θ of the present embodiment is an angle that causes the upper end of the rear end 12*b* and the upper end of the front end 13*a* to be substantially in the same position in the vertical direction. When the terminal-equipped electric wire 4 before coating formation is held with such an angle of inclination θ, the core wire 61 extends substantially horizontally between the core wire crimping part 12 and the e covering crimping part 13.

The ejecting part 72 ejects the droplets 3 of the ultraviolet-curing resin 7 toward the terminal-equipped electric wire 4 before coating formation held at the inclined attitude. The ejecting apparatus 70 intermittently ejects the droplets 3 from the nozzle 72*a* while reciprocating the nozzle 72*a* in the second direction W. In addition, the ejecting apparatus 70 moves the holding part 73A in the movement direction X while ejecting the droplets 3 by the ejecting apparatus 70. In other words, the ejecting apparatus 70 relatively moves the nozzle 72*a* and the terminal-equipped electric wire 4 before coating formation in two directions orthogonal to the ejection direction of the droplets 3 (the vertical direction). The droplets 3 that have adhered to the terminal-equipped electric wire 4 before coating formation form a coating 8 (refer to FIG. 14). The ejecting apparatus 70 forms the coating 8 in order from the covering crimping part 13 toward the terminal connecting part 11, for example.

The formed coating 8 integrally covers the core wire 61 and the crimp terminal 1 similarly to the coating 6. The coating 8 integrally covers the front end 61*a* of the core wire 61, the core wire crimping part 12, the intermediate exposed part 61*b* of the core wire 61, the covering 62, and the covering crimping part 13 as illustrated in FIG. 14, for example. The ultraviolet-curing resin 7 also penetrates the space between the element wires of the core wire 61. The ultraviolet-curing resin 7 that has penetrated the space between the element wires blocks an opening of the covering 62. In other words, the ultraviolet-curing resin 7 not only covers the outer circumferential face of the core wire 61 but also penetrates the space between the element wires to cover the element wires and blocks the opening of the covering 62.

In addition, the ultraviolet-curing resin 7 fills a gap 16 formed between the crimp terminal 1 and the core wire 61. As illustrated in FIG. 13, the gap 16 is formed inside the crimp terminal 1. The gap 16 is a space surrounded by the core wire 61, an inner face of the crimp terminal 1, and the front end 62*a* of the covering 62. The gap 16 illustrated in FIG. 13 is a space between an inner face of the bottom 15*a* of the intermediate part 15 and the core wire 61. The gap 16 is formed in accordance with a step defined by the front end 62*a* of the covering 62.

The terminal-equipped electric wire 4 before coating formation is held at the inclined attitude, thereby facilitating the filling of the gap 16 with the ultraviolet-curing resin 7. The ultraviolet-curing resin 7 that has penetrated the space between the element wires of the core wire 61 and the ultraviolet-curing resin 7 dripping along the outer circumferential face of the core wire 61 are guided to the gap 16. The guided ultraviolet-curing resin 7 fills the gap 16. In the present embodiment, the coating 8 is first formed on the covering crimping part 13, thereby ensuring the time for the ultraviolet-curing resin 7 to penetrate downward.

Because the imaginary line LI is substantially horizontal, the ultraviolet-curing resin 7 that has adhered to the core wire 61 is not likely to flow out in the first direction L. Consequently, in the coating 8, variations in thickness are not likely to occur in the part covering the intermediate exposed part 61*b*. In addition, the ultraviolet-curing resin 7 in not likely to move in the first direction L, and the ultraviolet-curing resin 7 that has adhered to an upper face of the intermediate exposed part 61*b* is likely to naturally penetrate downward as indicated by the arrow Y3. Consequently, the ultraviolet-curing resin 7 is likely to fill the gap 16.

Since the terminal-equipped electric wire 4 before coating formation is held at the inclined attitude, the ultraviolet-curing resin 7 is likely to penetrate the core wire 61 positioned inside the covering 62 as indicated by the arrow Y4. In other words, the blockage of the opening of the covering 62 by the ultraviolet-curing resin 7 is facilitated. Because the terminal-equipped electric wire 4 before coating formation is inclined, the ultraviolet-curing resin 7 is likely to penetrate the inner part in the first direction L. The ultraviolet-curing resin 7 accumulates in the gap 16 to lift a liquid level, making the ultraviolet-curing resin 7 likely to flow into the inside of the opening of the covering 62. In addition, the adhesiveness of the ultraviolet-curing resin 7 applied to the intermediate exposed part 61*b* to the core wire 61 improves. The ultraviolet-curing resin 7 fills the gap 16, and the ultraviolet-curing resin 7 is likely to penetrate the internal space of the covering 62, thus the terminal-equipped electric wire 5 can be protected from corrosion more surely.

Because the terminal-equipped electric wire 4 before coating formation is held at the inclined state, the ultraviolet-curing resin 7 is not likely to flow toward the terminal connecting part 11. In addition, the coating 8 covering the front end 61*a* of the core wire 61 can be made thick. The coating 8 covering the front end 61*a* is made thick, thereby improving redundancy in the prevention of the exposure of the front end 61*a*.

The angle of inclination θ may be an angle larger than the angle that makes the imaginary line LI horizontal. In other words, the angle of inclination θ may be an angle that causes the upper end of the rear end 12*b* of the core wire crimping part 12 to be positioned above the upper end of the front end 13*a* of the covering crimping part 13 in the vertical direction. The maximum value of the angle of inclination θ may be 45 degrees, for example.

After the coating 8 is formed, the irradiating process is performed. The irradiating process is performed after the completion of the coating forming process or in parallel with the coating forming process. At the irradiating process, the ultraviolet irradiating apparatus 76 irradiates the coating 8 with ultraviolet rays similarly to the irradiating process illustrated in FIG. 9, for example. Being irradiated with the ultraviolet rays at the irradiating process, the coating 8 cures. The applied ultraviolet rays are diffusely reflected by the surfaces of the element wires of the core wire 61 to reach the ultraviolet-curing resin 7 that has penetrated the inside of the core wire 61. Consequently, the ultraviolet-curing resin 7 that has penetrated the space between the element wires and the ultraviolet-curing resin 7 that has penetrated the internal space of the covering 62 cure at the irradiating process. In parallel with the irradiating process or before and after the irradiating process, treatment for curing the ultraviolet-curing resin 7 may be performed. Treatment for heat curing may be performed, for example.

The ejecting apparatus 70 holding the terminal-equipped electric wire 4 before coating formation at the inclined attitude may relatively move the nozzle 72*a* and the terminal-equipped electric wire 4 before coating formation in the vertical direction. The ejecting apparatus 70 may have a moving mechanism that relatively moves the ejecting part 72 in the vertical direction (the ejection direction) relative to the main body 71, for example. Alternatively, the ejecting apparatus 70 may have a moving mechanism that relatively moves the holding part 73A in the vertical direction (the ejection direction) relative to the main body 71.

As described above, the method for manufacturing a terminal-equipped electric wire according to the present embodiment includes the coating forming process (FIG. 6 and FIG. 7) and the irradiating process (FIG. 9). The coating forming process is a process for forming, on the terminal-equipped electric wire 4 having the crimp terminal 1, the coating 6 of the ultraviolet-curing resin 7 that integrally covers the core wire 61 and the crimp terminal 1. The crimp terminal 1 includes the core wire crimping part 12 that holds the core wire 61 of the electric wire 60 between the tips 22*a* and 23*a* of the pair of barrel pieces 22 and 23 connected to the bottom 21 and the bottom 21 and the covering crimping part 13 crimped to the covering 62 of the electric wire 60. The irradiating process is a process for irradiating the coating 6 with ultraviolet rays.

The method for manufacturing a terminal-equipped electric wire of the present embodiment, at the coating forming process, while the discharge port 72*c* that intermittently ejects the droplets 3 of the ultraviolet-curing resin 7 and the terminal-equipped electric wire 4 before coating formation are moved relative to each other, forms the coating 6 by the ultraviolet-curing resin 7 ejected from the discharge port 72*c*. A direction of the relative movement of the discharge port 72*c* and the terminal-equipped electric wire 4 before coating formation at the coating forming process is a direction orthogonal to the ejection direction of the droplets 3.

The method for manufacturing a terminal-equipped electric wire of the present embodiment forms the coating 6 by the droplets 3 of the ultraviolet-curing resin 7 intermittently ejected. With this method of coating formation, deviation in the position to which the droplets 3 adhere is not likely to occur even when the distance between the discharge port 72*c* and the target part in the ejection direction varies. The method for manufacturing a terminal-equipped electric wire of the present embodiment forms the coating 6 without relatively moving the discharge port 72*c* and the terminal-equipped electric wire 4 before coating formation in the ejection direction. Consequently, the method for manufacturing a terminal-equipped electric wire of the present embodiment can reduce the time required for the coating forming process to improve productivity.

The direction of the relative movement of the discharge port 72*c* and the terminal-equipped electric wire 4 before coating formation at the coating forming process includes two directions orthogonal to the ejection direction of the droplets 3. These two directions are a width direction of the crimp terminal 1 (the second direction W) and a direction orthogonal to the width direction. The relative movement in the two orthogonal directions can form the coating 6 in an appropriate range. The formed width of the coating 6 in the width direction of the crimp terminal 1 can be freely adjusted, for example. The thickness of the coating 6 can be freely adjusted at each place, for example. Consequently, the dwell time of the nozzle 72*a* at each position can be minimized to improve productivity.

In the present embodiment, in the pair of barrel pieces 22 and 23, the curved parts 22*b* and 23*b* between the basal ends 22*c* and 23*c*, respectively, connected to the bottom 21 and the tips 22*a* and 23*a*, respectively, are in contact with each other. At the coating forming process, the ultraviolet-curing resin 7 fills the groove 24 defined by the curved parts 22*b* and 23*b* being in contact with each other. The ultraviolet-curing resin 7 that has filled the groove 24 hinders water and the like from accumulating in the groove 24. Consequently, the degradation of the barrel pieces 22 and 23 is suppressed to improve the reliability of the terminal-equipped electric wire 5.

At the coating forming process, the ultraviolet-curing resin 7 may fill the groove 24 such that the ultraviolet-curing resin 7 piles up to a position higher than the tops of the curved parts 22*b* and 23*b*. The ultraviolet-curing resin 7 fills the groove 24 in this manner, thereby suppressing the degradation of the barrel pieces 22 and 23 more surely.

In the present embodiment, the amount of the droplets 3 ejected at a time is an amount that causes a spread of the droplets 3 when adhering to the core wire crimping part 12 to be smaller than the width of the core wire crimping part 12. Consequently, the ultraviolet-curing resin 7 is hindered from adhering to the side faces of the core wire crimping part 12.

Modification of Embodiment

At the coating forming process, means for facilitating the penetration of the ultraviolet-curing resin 7 to a section of the core wire 61 covered with the covering 62 may be used. The coating forming process may be performed in a pressurizing room, for example. In this case, the ejecting apparatus 70 and the terminal-equipped electric wire 4 before coating formation are placed in the pressurizing room. The end of the electric wire 60 opposite to the crimp terminal 1 is preferably placed outside the pressurizing room. The ultraviolet-curing resin 7 that has adhered to the core wire 61 is more likely to penetrate the inside of the covering 62 through a pressure difference.

The coatings 6 and 8 of the ultraviolet-curing resin 7 may be formed so as not to cover the covering crimping part 13 and to cover the covering 62. The coatings 6 and 8 may be formed so as not to cover at least the outer circumferential face of the covering crimping part 13, for example. In this case, the coatings 6 and 8 may be allowed to cover the front end 13*a* of the covering crimping part 13.

The details disclosed in the embodiment and the modification can be performed in combination as appropriate.

The method for manufacturing a terminal-equipped electric wire according to the present embodiment includes a coating forming process for forming, on a terminal-equipped electric wire having a terminal including a core wire crimping part that holds a core wire of an electric wire between tips of a pair of conductor crimping pieces connected to a bottom wall and the bottom wall and a covering crimping part crimped to a covering of the electric wire, a coating of an ultraviolet-curing resin that integrally covers the core wire and the terminal, and an irradiating process for irradiating the coating with ultraviolet rays. At the coating forming process, while a discharge port that intermittently ejects droplets of the ultraviolet-curing resin and the terminal-equipped electric wire are moved relative to each other, the coating is formed from the ultraviolet-curing resin ejected from the discharge port. A direction of the relative movement of the discharge port and the terminal-equipped electric wire at the coating forming process is a direction orthogonal to an ejection direction of the droplets.

The method for manufacturing a terminal-equipped electric wire according to the present embodiment forms the coating by the droplets of the ultraviolet-curing resin intermittently ejected. With this method of coating formation, deviation in the position to which the droplets adhere is not likely to occur even when the distance between the discharge port and the target part in the ejection direction varies. The method for manufacturing a terminal-equipped electric wire according to the present embodiment forms the coating without relatively moving the discharge port and the terminal-equipped electric wire in the ejection direction, thereby producing an effect of making it possible to reduce the time required for the coating forming process and to improve productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method for manufacturing a terminal-equipped electric wire, the method comprising:

forming, on a terminal-equipped electric wire having a terminal including a core wire crimping part that holds a core wire of an electric wire between tips of a pair of conductor crimping pieces connected to a bottom wall and the bottom wall and a covering crimping part crimped to a covering of the electric wire, a coating of an ultraviolet-curing resin that integrally covers the core wire and the terminal; and irradiating the coating with ultraviolet rays, wherein at the forming, while a discharge port that intermittently ejects droplets of the ultraviolet-curing resin and the terminal-equipped electric wire are moved relative to each other, the coating is formed from the ultraviolet-curing resin ejected from the discharge port, a direction of the relative movement of the discharge port and the terminal-equipped electric wire at the forming is a direction orthogonal to an ejection direction of the droplets, at the forming, the discharge port ejects the droplets having a constant amount at regular time intervals, and thickness of the coating is adjusted by the relative movement speed of the discharge port and the terminal-equipped electric wire.

2. The method for manufacturing a terminal-equipped electric wire according to claim 1, wherein the direction of the relative movement of the discharge port and the terminal-equipped electric wire at the forming includes two directions orthogonal to the ejection direction of the droplets, and the two directions are a width direction of the terminal and a direction orthogonal to the width direction.

3. The method for manufacturing a terminal-equipped electric wire according to claim 1, wherein in the pair of conductor crimping pieces, curved parts between respective basal end parts connected to the bottom wall and respective tips holding the core wire are in contact with each other, and at the forming, the ultraviolet-curing resin fills a groove defined by the curved parts being in contact with each other.

4. The method for manufacturing a terminal-equipped electric wire according to claim 2, wherein in the pair of conductor crimping pieces, curved parts between respective basal end parts connected to the bottom wall and respective tips holding the core wire are in contact with each other, and at the forming, the ultraviolet-curing resin fills a groove defined by the curved parts being in contact with each other.

5. The method for manufacturing a terminal-equipped electric wire according to claim 3, wherein at the forming, the ultraviolet-curing resin fills the groove such that the ultraviolet-curing resin piles up to a position higher than tops of the curved parts.

6. The method for manufacturing a terminal-equipped electric wire according to claim 4, wherein at the forming, the ultraviolet-curing resin fills the groove such that the ultraviolet-curing resin piles up to a position higher than tops of the curved parts.

7. The method for manufacturing a terminal-equipped electric wire according to claim 1, wherein an amount of the droplets ejected at a time is an amount that causes a spread of the droplets when adhering to the core wire crimping part to be smaller than a width of the core wire crimping part.

8. The method for manufacturing a terminal-equipped electric wire according to claim 2, wherein an amount of the droplets ejected at a time is an amount that causes a spread of the droplets when adhering to the core wire crimping part to be smaller than a width of the core wire crimping part.

9. The method for manufacturing a terminal-equipped electric wire according to claim 3, wherein an amount of the droplets ejected at a time is an amount that causes a spread of the droplets when adhering to the core wire crimping part to be smaller than a width of the core wire crimping part.

10. The method for manufacturing a terminal-equipped electric wire according to claim 5, wherein an amount of the droplets ejected at a time is an amount that causes a spread of the droplets when adhering to the core wire crimping part to be smaller than a width of the core wire crimping part.

11. The method for manufacturing a terminal-equipped electric wire according to claim 1, wherein at the forming, moving the discharge port in the width direction of the terminal, and moving the terminal-equipped electric wire in the direction orthogonal to the width direction.

* * * * *